US009652923B2

(12) United States Patent
Doom

(10) Patent No.: US 9,652,923 B2
(45) Date of Patent: May 16, 2017

(54) ADA COMPLIANCE IN VENDING MACHINES

(71) Applicant: Crane Merchandising Systems, Inc., Malvern, PA (US)

(72) Inventor: Troy Doom, North Augusta, SC (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 0 days.

(21) Appl. No.: 14/711,659

(22) Filed: May 13, 2015

(65) Prior Publication Data

US 2015/0243120 A1 Aug. 27, 2015

Related U.S. Application Data

(62) Division of application No. 13/457,332, filed on Apr. 26, 2012, now abandoned.

(60) Provisional application No. 61/479,287, filed on Apr. 26, 2011.

(51) Int. Cl.
*G07F 11/16* (2006.01)
*G07F 9/02* (2006.01)

(52) U.S. Cl.
CPC ..... *G07F 11/16* (2013.01); *G07F 9/023* (2013.01)

(58) Field of Classification Search
CPC ..... G07F 11/16; G07F 9/023
USPC ..... 221/192
See application file for complete search history.

(56) References Cited

U.S. PATENT DOCUMENTS

| | | | | | |
|---|---|---|---|---|---|
| 3,344,953 | A * | 10/1967 | Krakauer | G07F 11/42 | 198/657 |
| 3,901,366 | A * | 8/1975 | Schuller | G07F 11/42 | 194/210 |
| 4,094,440 | A * | 6/1978 | Lotspeich | G07F 9/00 | 221/12 |
| 5,375,737 | A * | 12/1994 | Ficken | G07F 11/00 | 109/48 |
| 5,909,823 | A * | 6/1999 | Ranft | G07F 11/16 | 221/129 |
| 6,494,342 | B1 * | 12/2002 | Wittern, III | G07F 11/10 | 221/192 |
| 6,840,400 | B2 * | 1/2005 | Park | G07F 11/10 | 221/12 |
| 8,095,236 | B2 | 1/2012 | Rudy et al. | | |

* cited by examiner

*Primary Examiner* — Timothy Waggoner

(57) ABSTRACT

An ADA compliant vending machine ensures provides a user control for entering an ADA mode, and displays all user-actuated vend transaction controls below a first specified height when operating in the ADA mode. A delivery bucket surface on which vended products are supported moves between a lowered position below a second specified height and a raised position above the second specified height in coordinate operation with opening of the delivery bin door. Products are dropped below the second specified height during delivery but are raised above that height for customer retrieval. Mechanical force required to open the delivery bin door is less than five pounds, even with closing of anti-pilfer flaps also being coordinated with opening of the delivery bin door.

6 Claims, 10 Drawing Sheets

ADA COMPLIANCE IN VENDING MACHINES

CROSS-REFERENCE TO RELATED APPLICATIONS

This application is a division of U.S. Non-Provisional patent application Ser. No. 13/457,332 entitled "ADA COMPLIANCE IN VENDING MACHINES" and filed on Apr. 26, 2012, and claims priority to U.S. Provisional Patent Application Ser. No. 61/479,287 entitled "ADA COMPLIANCE IN VENDING MACHINES" and filed on Apr. 26, 2011. The content of the above-identified patent documents is incorporated herein by reference.

TECHNICAL FIELD

The present application relates generally to the customer user interface and delivery mechanism in vending machines and, more specifically, to the modification of the user interface and delivery bin within a vending machine to promote compliance with the Americans with Disabilities Act (ADA).

BACKGROUND

Vending machines offer unattended sales of commodities such as snacks, canned or bottled beverages, or any of a variety of other articles. *The Revised ADA Regulations Implementing Title II and Title III* issued by the Department of Justice in relation to the Americans with Disabilities Act and effective Mar. 15, 2011 (see 28 Code of Federal Regulations parts 35 and 36) alter the "side reach" range requirements to provide that the side reach range must now be no higher than 48" instead of 54" and no lower than 15" instead of 9". In addition, the force required to operate any mechanical mechanism must be less than 5 pounds (lbs).

There is, therefore, a need in the art for an improved customer user interface as well as product dispensing mechanism for vending machines.

SUMMARY

An ADA compliant vending machine ensures provides a user control for entering an ADA mode, and displays all user-actuated vend transaction controls below a first specified height when operating in the ADA mode. A delivery bucket surface on which vended products are supported moves between a lowered position below a second specified height and a raised position above the second specified height in coordinate operation with opening of the delivery bin door. Products are dropped below the second specified height during delivery but are raised above that height for customer retrieval. Mechanical force required to open the delivery bin door is less than five pounds, even with closing of anti-pilfer flaps also being coordinated with opening of the delivery bin door.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 9B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged vending machine customer product selection interface and product delivery bin system.

Figure 1:
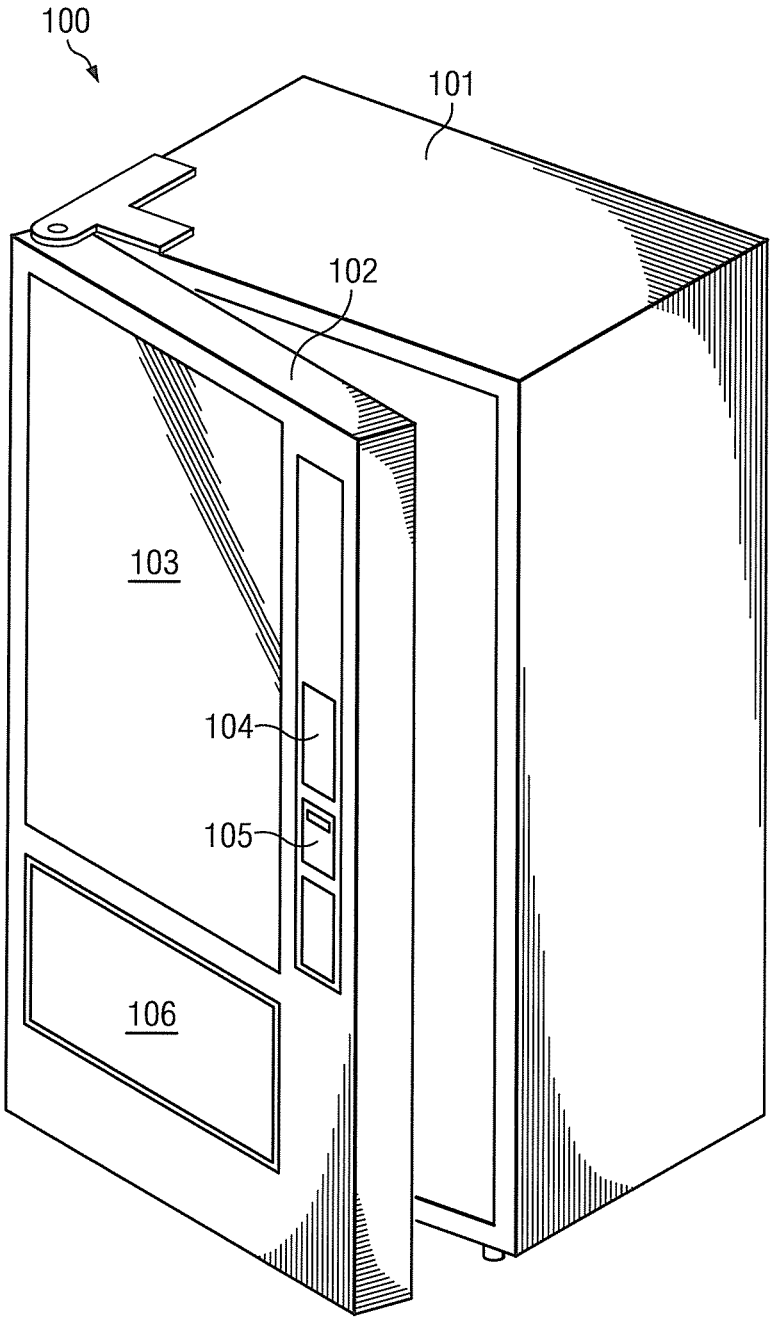
FIG. 1 is a simplified perspective view illustrating a vending machine implementing an ADA compliant customer user interface and delivery bin according to one embodiment of the present disclosure.

FIG. 1 is a simplified perspective view illustrating a vending machine implementing an ADA compliant customer product selection interface and delivery bin according to one embodiment of the present disclosure. Vending machine 100 includes a cabinet 101 and a service door 102 that, together, define an enclosure. In the exemplary embodiment illustrated, the service door 102 is pivotally mounted to the front of the cabinet 101 and extends all the way across the front face of the vending machine 100. In alternate designs, the service door may extend only part way across the front of the vending machine, or may be formed in two portions (of equal or unequal sizes) that swing open in opposite directions.

In the exemplary embodiment illustrated in FIG. 1, the service door 102 includes a transparent front 103 allowing the customer to view actual products available for vending, which may include snacks, packaged beverages, various sundries, or any product capable of being dispensed by the vending machine.

Vending machine 100 also includes a customer product selection interface 104, payment mechanism access 105 and a delivery bin door 106. Customer product selection interface 104 is preferably provided by a touch-screen liquid crystal display (LCD) display and input. Payment mechanism access 105 may include one or more of a coin slot allowing deposit of coins into a coin mechanism, a bill access slot for feeding paper currency into a bill validator and/or recycler, a magnetic stripe swipe mechanism for reading the magnetic stripe on credit or debit cards, or a Radio Frequency Identification (RFID) sensor for sensing a customer's RFID tag linked to a payment system.

FIG. 1 depicts delivery bin door 106 as positioned below the transparent window 103 and substantially across the width of the product columns behind the transparent window. Products available for vending are thus held in, for example, helical coils on shelves visible from the exterior through the transparent window 103 and are dropped through a space between the shelves and the transparent window 103 into the delivery bin behind delivery bin door 106. Those skilled in the art will recognize that in some vending machines, particularly beverage vending machines, an X-Y product retrieval and delivery mechanism delivers vended product to an access port to the side as shown in FIG. 1, at a height convenient to the customer for product retrieval without bending over.

Those skilled in the art will recognize that the complete structure of a vending machine is not depicted in the drawings, and the complete details of the structure and operation of the vending machine is not described herein. Instead, for simplicity and clarity, only so much of the structure and operation of a vending machine as is unique to the present disclosure or necessary for an understanding of the present invention is depicted and described.

Figure 2:
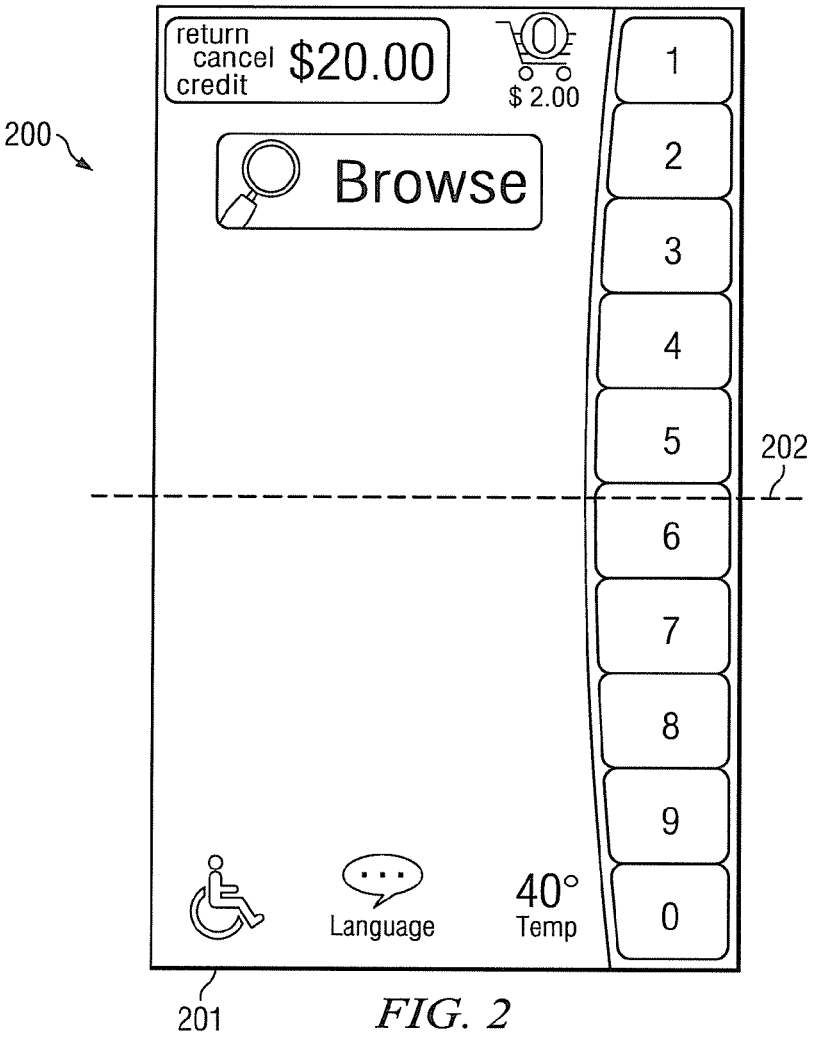
FIG. 2 illustrates a display screen for an ADA compliant customer product selection interface according to one embodiment of the present disclosure.
Figure 3:
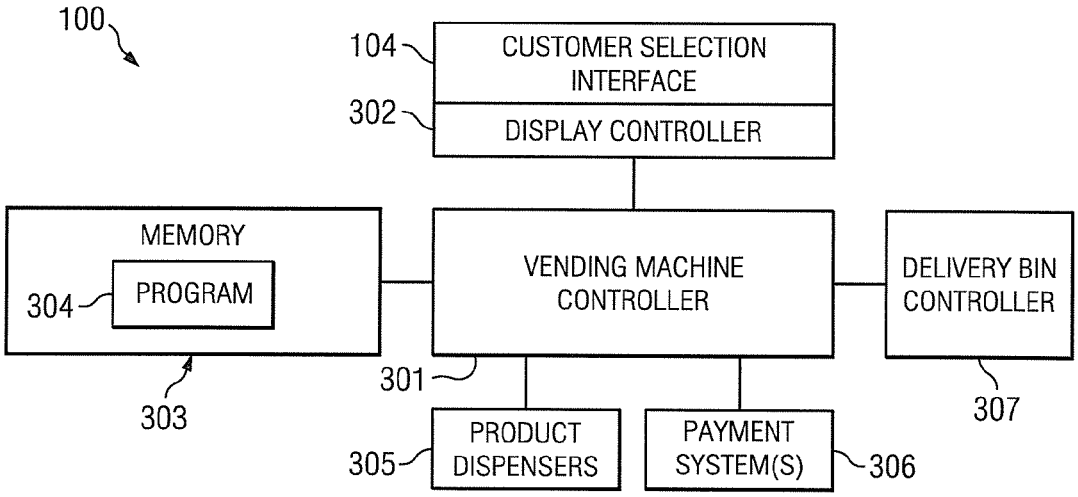
FIG. 3 is a block diagram of a control system within a vending machine implementing an ADA compliant customer product selection interface according to one embodiment of the present disclosure.

FIG. 2 illustrates a display screen for an ADA compliant customer product selection interface according to one embodiment of the present disclosure. FIG. 3 is a block diagram of a control system within a vending machine implementing an ADA compliant customer product selection interface according to one embodiment of the present disclosure. The display screens for a customer product selection interface 104 are graphically displayed on a touch-screen LCD with selected display elements configured as user controls to actuate corresponding functions.

Vending machine 100 includes a programmable vending machine controller (VMC) 301 of the type known in the art. Coupled to and communicating with VMC 301 is a display controller 302 for the customer product selection interface 104. As noted above, the customer product selection interface 104 is preferably provided by a touch-screen liquid crystal display (LCD) display and input. Suitable touch-screen display devices and the associated controllers for use as customer product selection interface 104 and display controller 302 are known in the art. VMC 301 is also coupled to and in communication with product dispensers 305, payment systems 306 (which may include a coin mechanism, a bill recycler or validator, a magnetic stripe swipe reader and/or a RFID sensor), as well as a delivery bin controller 307.

The display controller 302 renders content for display on the customer product selection interface 104 and detects customer contact with predefined regions of the display for the touch screen. The predefined regions correspond to user controls and may vary from one display to another. The display content for each display is stored in a memory 303 within the vending machine and retrieved, together with the predefined regions that form user controls for the respective display, by a control program 304 residing in memory 303. (Although depicted in FIG. 3 as separate from VMC 301, memory 303 may actually be part of the same integrated circuit as VMC 301). VMC 301 and display controller 302 cooperate to render the display on customer product selection interface 104 and respond to user contact with one of the predefined regions for a current display.

An exemplary display 200 for customer product selection interface 104 is depicted in FIG. 2. In the exemplary embodiment, each display includes an ADA user control 201 located in the bottom left corner of the display. The ADA control 201 is an image of an individual within a wheelchair, a conventional symbol for facilities customized or reserved for disabled persons. In other disclosed embodiments, the ADA control 201 may be a different symbol or located in another location on the customer product selection interface 104. The location of ADA control 201 is below 48" and above 15" above the surface on which vending machine 100 rests, and is thus always compliant with side reach regulations.

The ADA control 201 transitions the control program 304 into ADA mode, in which all user control or actuation elements of every display for the remainder of the vend transaction are rendered only within the portion of the display located on customer product selection interface 104 below the ADA 48" upper limit 202. The ADA control 201 may be actuated at any time during a vend transaction to transition into the ADA mode of operation. Since the payment access slots 105 are located below the customer product selection interface 104, those user interface aspects are already below the ADA 48" upper limit 202.

Figure 4A:
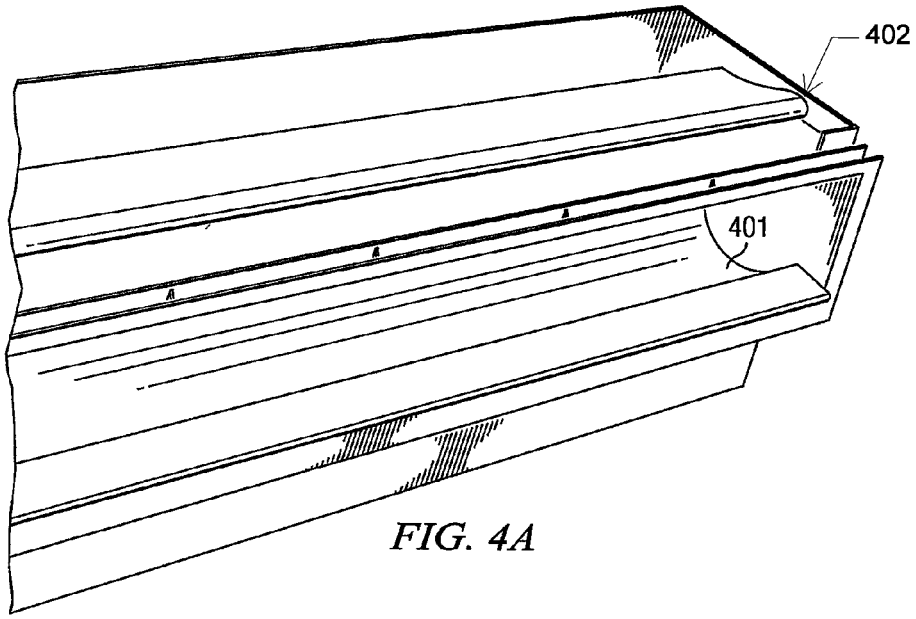
FIGS. 4A and 4B illustrate portions of an ADA compliant delivery bin according to one embodiment of the present disclosure.
Figure 4B:
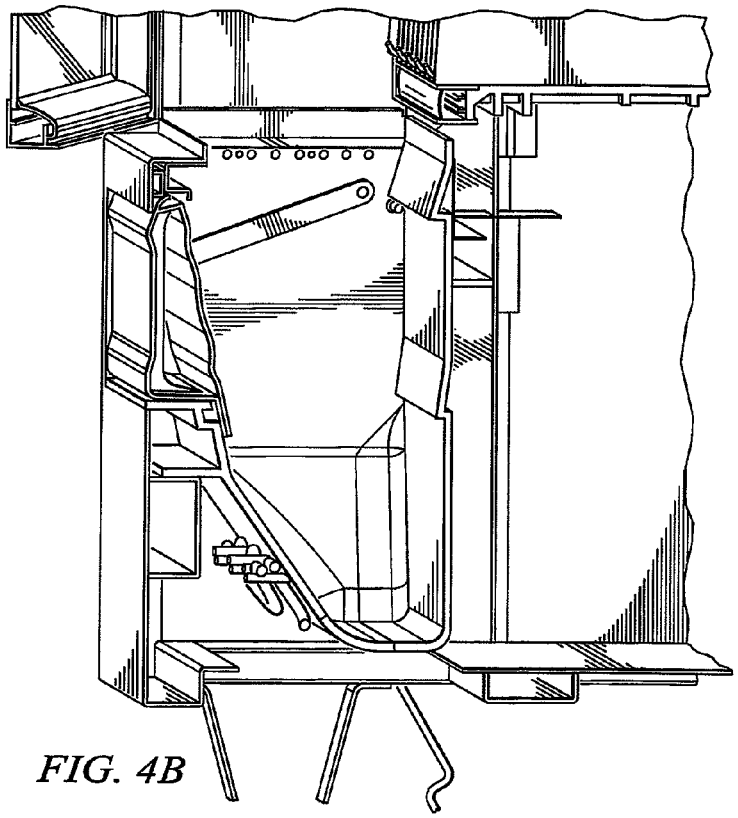

FIGS. 4A and 4B illustrate portions of an ADA compliant delivery bin according to one embodiment of the present disclosure. In order to maximize the number of product trays within a helical coil snack vending machine, typically the bottom of the delivery bin is below the ADA 15" lower limit. The delivery bin of the present disclosure utilizes a rising delivery bin moving floor to raise the vended product therein above the ADA 15" lower limit. A flexible net (mesh) or fabric 401 having a J-shaped side-section is secured within the delivery bin at the front, attached below door. The flexible material 401 thus forms the front wall, the bottom (or floor) and the back wall of the delivery bin. Side brackets illustrated in FIG. 4B limit the range of motion of the flexible material 401, which is resistant to tearing or cutting and sufficient stiff to inhibit bending in directions other than as described below.

During product delivery, the flexible material 401 is pulled up in back by a motor that runs a mandrel 402 to roll up the fabric, causing the bottom of the delivery bin (and any products thereon) to rise. Products in the delivery bin can always be retrieved prior to floor coming to final level, such that the movement of the delivery bin floor does not slow the vend transaction. In any event, the movable floor of the delivery bin raises up to ADA height and the product may be retrieved at that height.

Figure 5A:
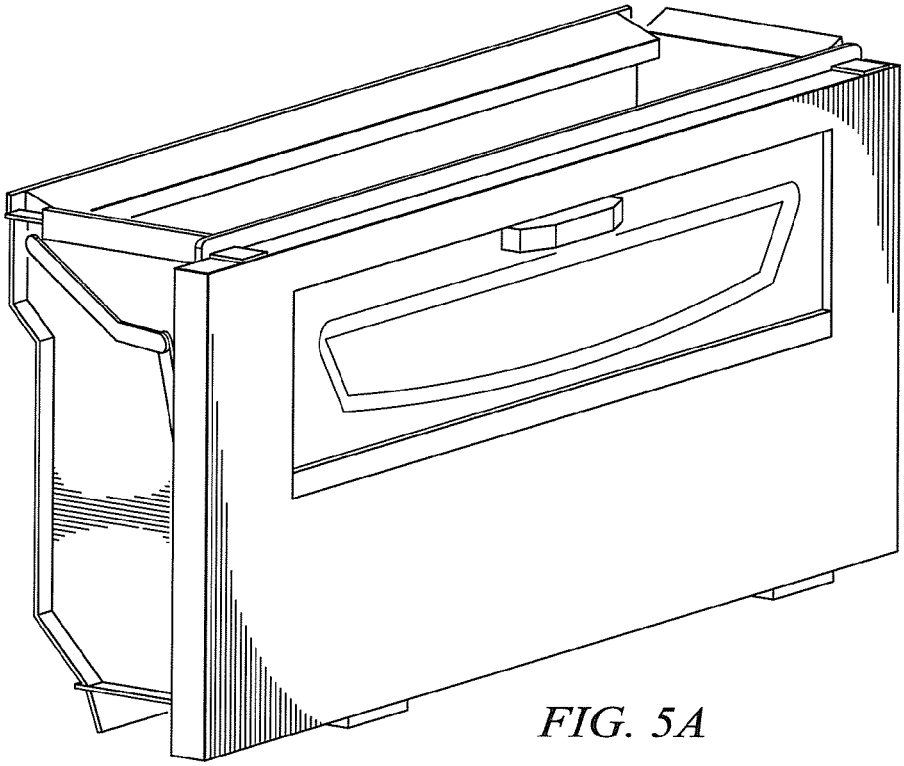
FIGS. 5A through 5D illustrate an ADA compliant delivery bin according to one embodiment of the present disclosure.
Figure 5B:
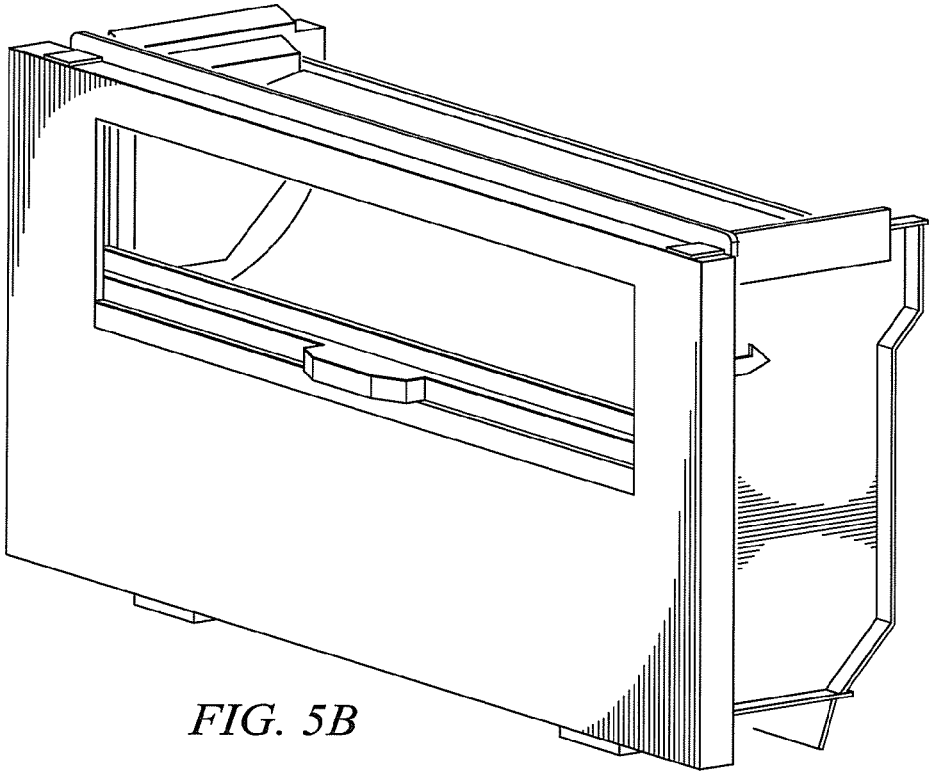
Figure 5D:
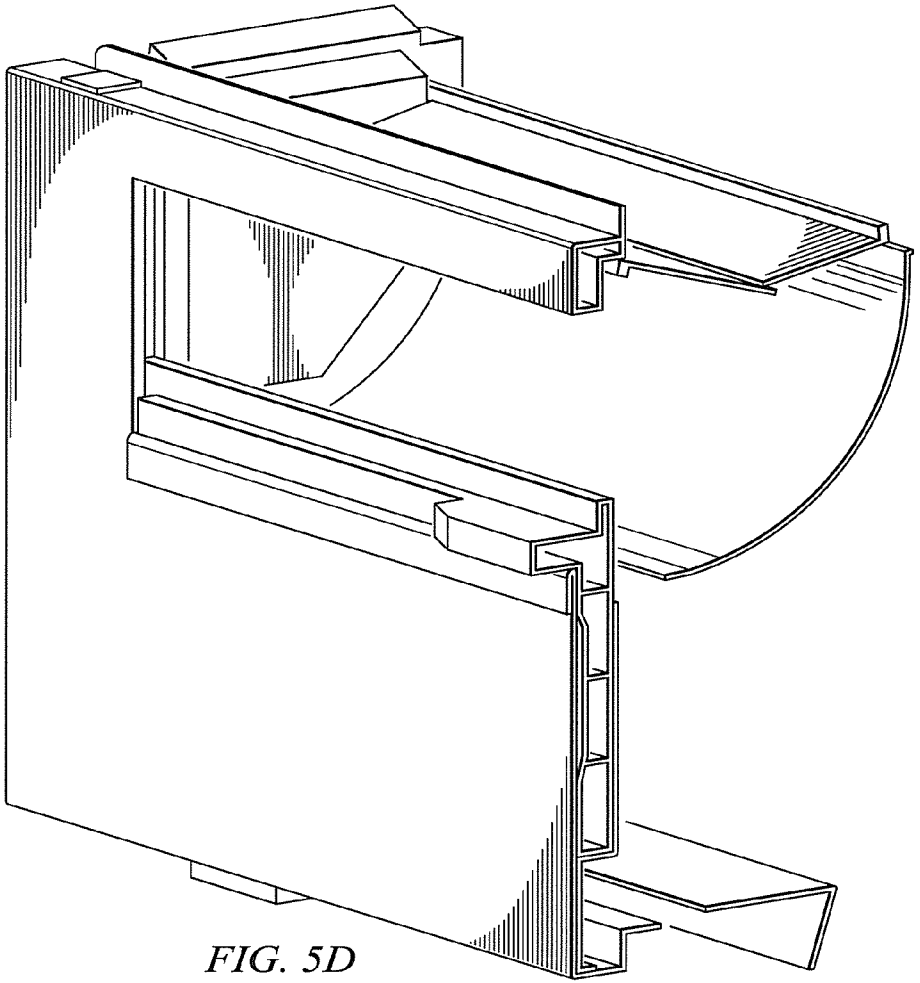
Figure 5C:
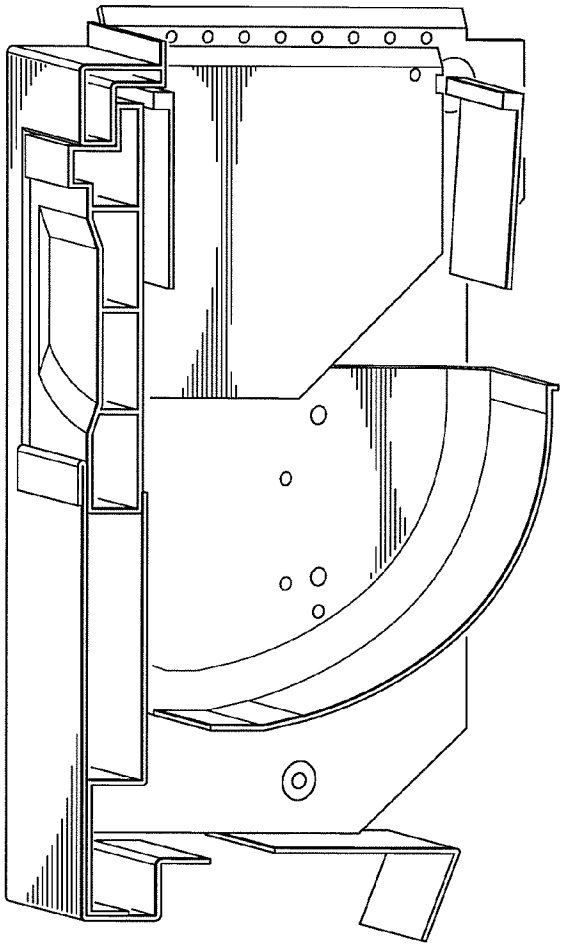

FIGS. 5A through 5D illustrate an ADA compliant delivery bin according to one embodiment of the present disclosure. In the example shown, a motorized delivery door is provided, which moves down to allow access by the customer to the delivery bin. FIG. 5A is a perspective view with the delivery door closed and the bin floor lowered (i.e., the flexible material unfurled as much as possible from the mandrel), while FIG. 5B is a perspective view of the delivery door open and the bin floor raised (i.e., the flexible material wound at least partial and most likely more than one turn around the mandrel). The floor of the bin is thus raised and lowered with opening or closing of the delivery door—that is, the bin floor (and any products thereon) is raised when door is actuated down, and lowered again when door returns to a closed position. A pulley and/or gear drive coordinates movement between the delivery bin door and the mandrel on which the flexible material is wound or unwound.

The use of a flexible material as described allows any size product to be delivered and raised to an ADA height (15" from the floor) without removing any trays from the vending machine or otherwise limiting the available product storage space. Thus, the distance between the lowest tray and the bottom of the delivery bin when the product is retrieved is minimized, while reliably delivering the vended product. For anti-pilferage reasons, the opening to the product tray area will be block when the delivery door is lowered, which may also be driven by the motor that opens or closes the delivery door and/or raises/lowers the bin floor.

Of course, the bin floor need be raised and lowered only when the vending machine 100 is operating in ADA mode (i.e., when the ADA screen button is pressed at the beginning of the workflow, or during the last screen display prior to delivery, etc.).

Figure 6A:
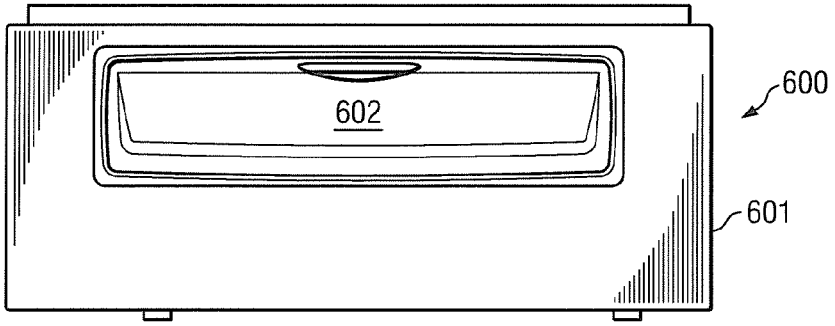
FIGS. 6A and 6B is front and side views, respectively, of an ADA compliant delivery bin according to another embodiment of the present disclosure.
Figure 6B:
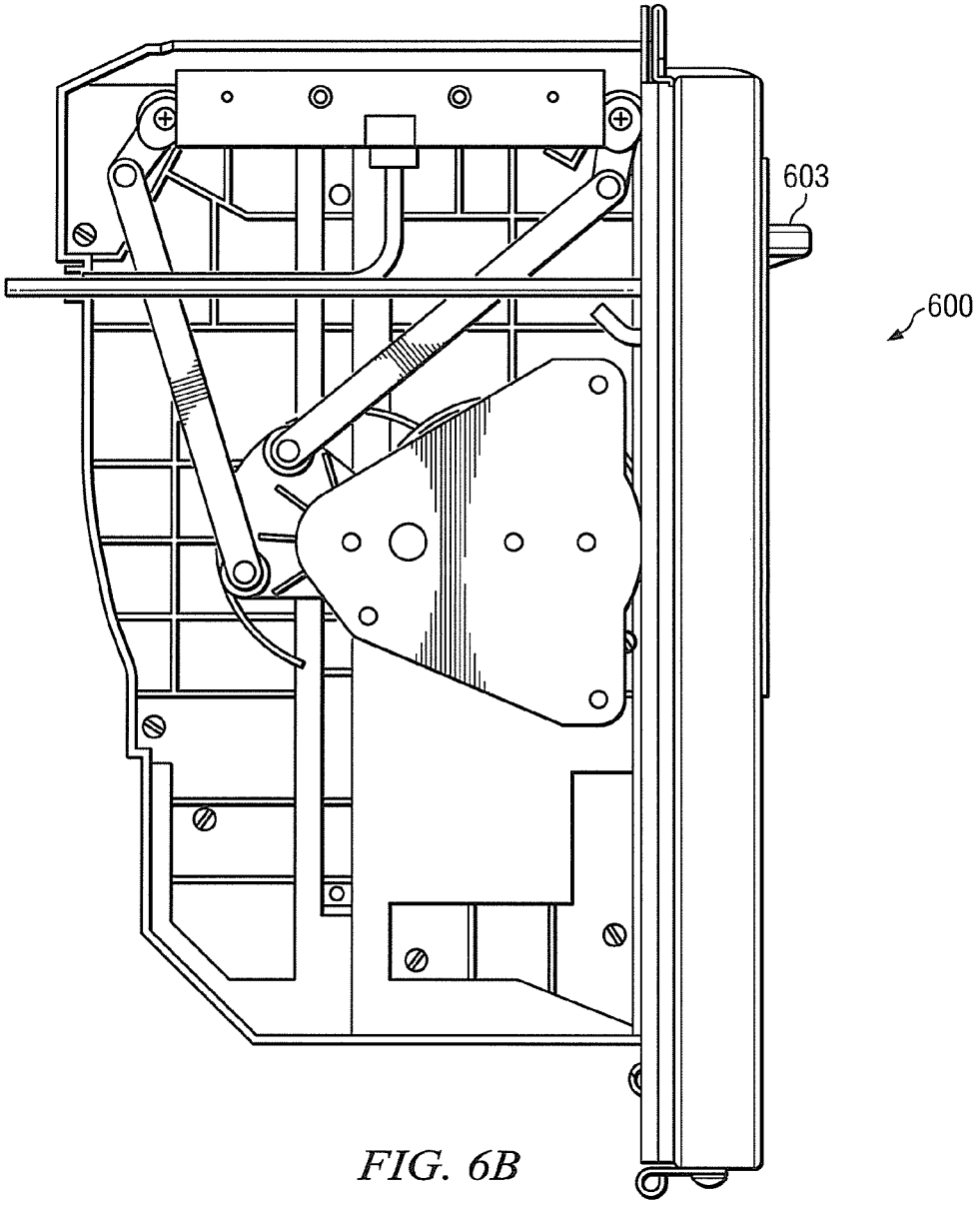

FIGS. 6A and 6B is front and side views, respectively, of an ADA compliant delivery bin according to another embodiment of the present disclosure. The delivery bin 600 includes a front panel 601 that forms a portion of a front facing of the vending machine 100. The delivery bin door 601 (illustrated diagrammatic-ally as door 106 in FIG. 1) covers an opening through the front panel 601 and includes a push protrusion 603 near the top thereof. The side panels (one of which is visible in FIG. 6B) and bottom and rear panels (not shown) form a complete, open-top enclosure for receiving products. In alternative embodiments at least the rear panel for the delivery bin 600 may be formed by a portion of the interior cabinet for the vending machine. Likewise the bottom panel need not be integral to the remainder of the delivery bin 600. In the side view, portions of the gearing mechanism coordinating movement between door 601 and anti-theft flaps is visible.

Figure 7A:
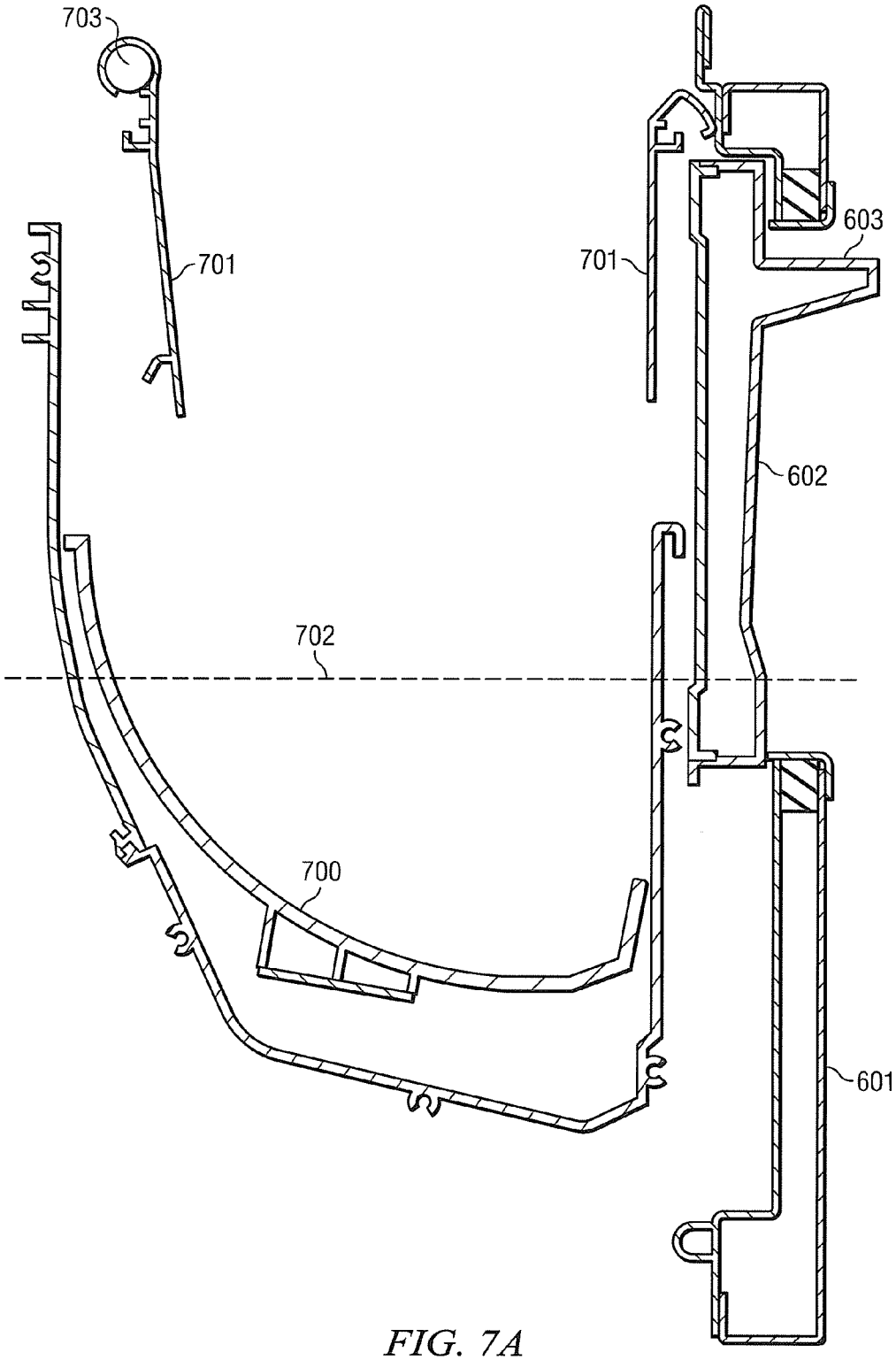
FIGS. 7A and 7B are center sectional views of the ADA compliant delivery bin depicted in FIGS. 6A and 6B, with the delivery bin door closed and open, respectively.
Figure 7B:
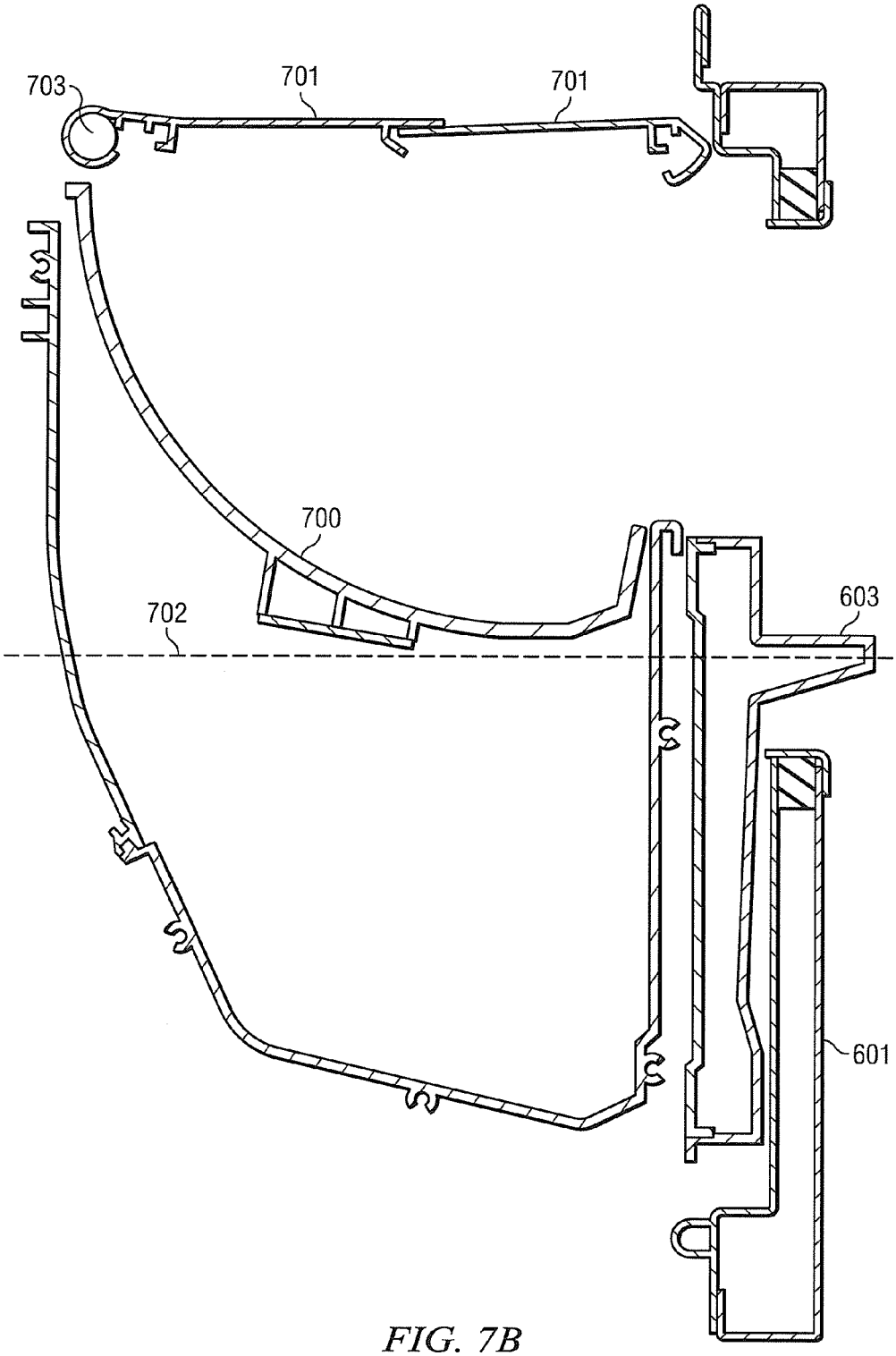

FIGS. 7A and 7B are center sectional views of the ADA compliant delivery bin depicted in FIGS. 6A and 6B, with the delivery bin door closed and open, respectively. As illustrated, door 602 opens by sliding down inside front panel 601, along tracks (not shown) in response to downward force by the customer on push protrusion 603. Based on the counterweights and spring-biasing system, the force required to open door 603 is less than 5 pounds (lbs). Delivery bin 600 also includes an internal, rigid, generally J-shaped delivery bucket 700 (which need not include sidewalls) and anti-pilfer flaps 701, both of which moves coordinately with door 602. The delivery bucket 700 moves vertically up as the door 602 is pushed down; the extruded aluminum anti-pilfer flaps 701 each swing from generally vertical, "open" positions when the delivery bin door 602 is closed, allowing products to drop through the open top of the delivery bin 600 into the delivery bucket 700, to generally horizontal, "closed" positions when the delivery bin door 602 is open, in which the two flaps together block access to the product shelves above and generally behind the delivery bin 600.

The delivery bucket 700 has a curved surface from the rear toward the front, with a lowest point near the front of the delivery bin. The curvature causes products to slide toward the front of the delivery bin 600 for easy retrieval through delivery bin door 602. The delivery bucket 700 moves from a lowest position when the delivery bin door 602 is closed to a highest position when the delivery bin door 602 is open. As a result, in the exemplary embodiment products dropping into the delivery bucket 700 when the delivery bucket 700 is at the lowest limit of travel. The depth of the delivery bucket 700 relative to the anti-pilfer flaps 701 when the delivery bin door 602 is closed thus allows clearance for large products within the delivery bucket 700, without interference in movement of the anti-pilfer flaps. The point, however, is below the desired height 702 for the product during customer retrieval—for example, 15 inches above floor level. Movement of the delivery bucket 700 upward as the delivery bin door 602 is opened raises the lowest point in delivery bucket 700 above that desired height 702. The design of the delivery bin 600 allows more products (i.e., an additional shelf) to be held within a vending machine having a height allow the machine to be moved through most doorways, by allowing the product to drop lower than desired height 702 to provide clearance for anti-pilfer flaps 701 while raising the product to or above the desired height 702 for retrieval by the customer.

Figure 8:
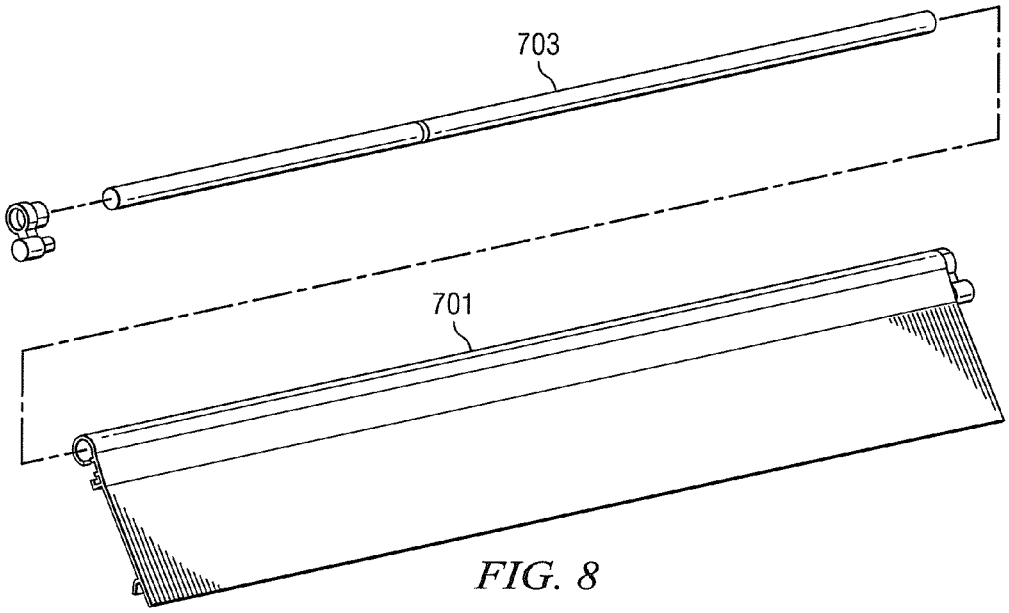
FIG. 8 is an exploded view of an anti-pilfer flap used in the ADA compliant delivery bin depicted in FIGS. 6A-6B and 7A-7B.
Figure 9:
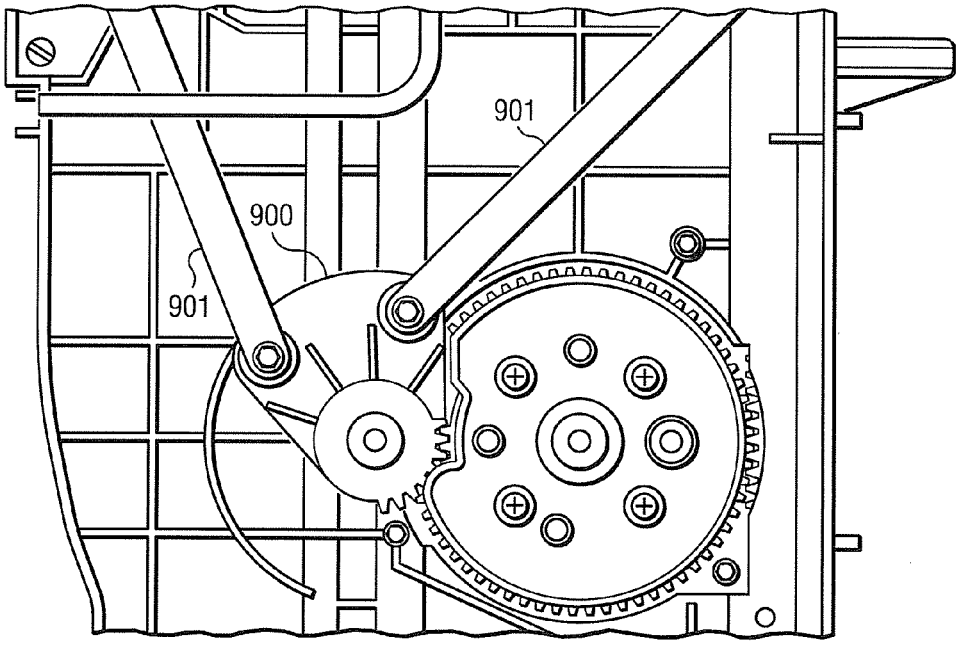
FIG. 9 depicts the linkage between the delivery bin door, delivery bucket and anti-pilfer flaps in the ADA compliant delivery bin depicted in FIGS. 6A-6B and 7A-7B.
Figure 9B:
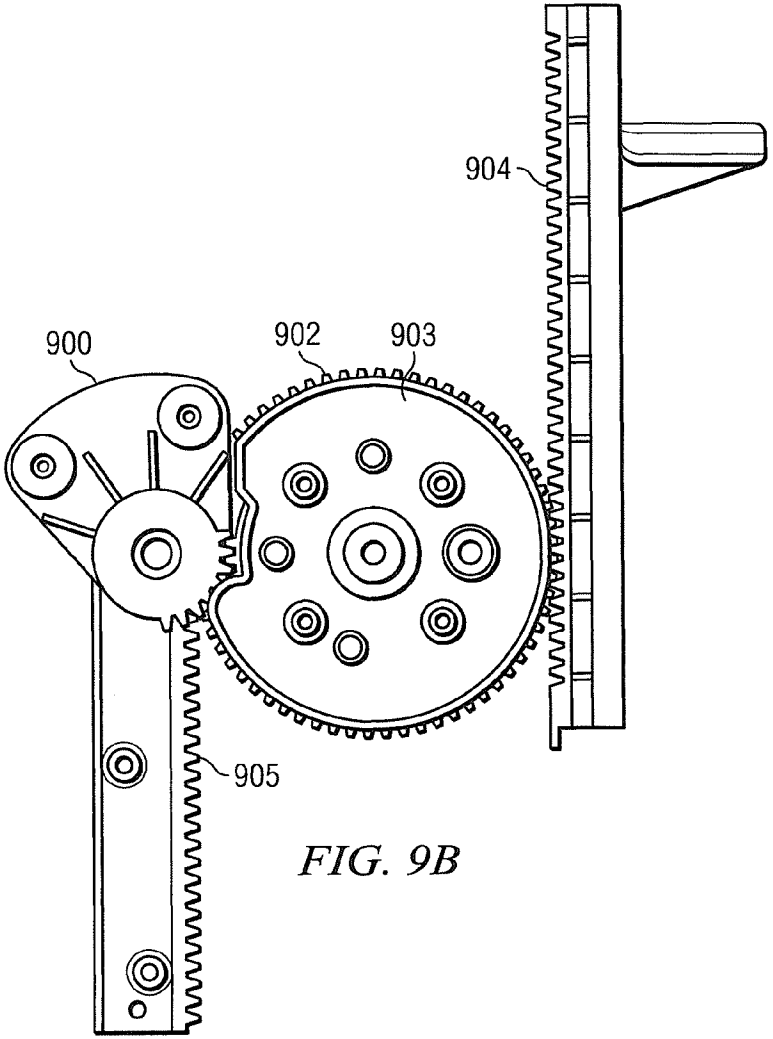
FIGS. 9A and 9B are detailed views of a portion of FIG. 9, with the delivery bin door closed and open, respectively.
Figure 9A:
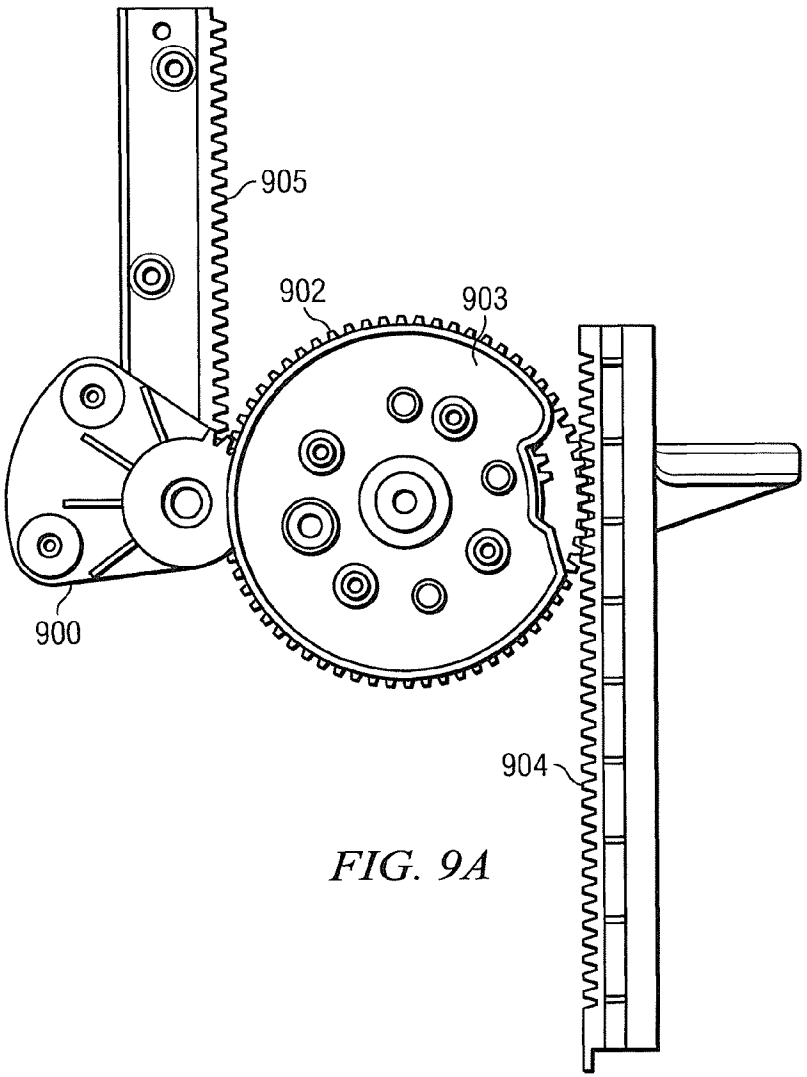

FIG. 8 is an exploded view of an anti-pilfer flap used in the ADA compliant delivery bin depicted in FIGS. 6A-6B and 7A-7B. FIG. 9 depicts the linkage between the delivery bin door, delivery bucket and anti-pilfer flaps in the ADA compliant delivery bin depicted in FIGS. 6A-6B and 7A-7B. FIGS. 9A and 9B are detailed views of a portion of FIG. 9, with the delivery bin door closed and open, respectively. Delivery bin 600 reduces the force required to open delivery bin door 602 to less than 5 lbs by employing counterweights to hold the anti-pilfer flaps open. At least one anti-pilfer flap 701 has a steel rod counterweight 703 secured thereto on the opposite side of the pivot point from the major surface of the anti-pilfer flap.

The anti-pilfer flaps 701 are each linked to a rotatable flap gear 900 by a linkage bar 901. The flap gear 900 has gear teeth only around a portion of the outer periphery that engage teeth on a main gear 902 (portions of which are visible behind cam 903 in FIGS. 9A and 9B). Main gear 902 also engages delivery bin door gear rack 904 and delivery bucket gear rack 905, which results in the delivery bucket 700 being raised when delivery bin door 602 is opened. As the delivery bin door 602 is pushed down to be opened, the gear teeth on flap gear 900 raise the anti-pilfer flaps 701 while the delivery bucket 700 is being raised (with counterweight 703 reducing the amount of force required). Once the anti-pilfer flaps 701 have closed, however, the flap gear teeth disengage from the main gear 902 and the flap gear 900 is held in place by cam 903, although further downward movement of the delivery bin door 602 continues to raise the delivery bucket 700 by operation of the main gear 902 between gear racks 904 and 905.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A method of providing a vending machine delivery bin, the method comprising:

providing a delivery bucket surface on which vended products are supported, the delivery bucket surface movable between a first position and a second position higher than the first position;

providing a delivery bin door moveable between open and closed positions, wherein movement of the delivery bin door is coordinated with movement of the delivery bucket surface such that the delivery bucket surface is at the first position when the delivery bin door is closed and at the second position when the delivery bin door is open, and wherein the movement of the delivery bin door and the movement of the delivery bucket surface are vertical, and providing a main gear positioned between a gear rack on the delivery bin door and a gear rack lifting the delivery bucket surface.

2. The method of claim 1, wherein the delivery bucket surface comprises a rigid, J-shaped surface that is mechanically moved in coordination with opening of the deliver bin door.

3. The method of claim 2, further comprising:

providing at least one anti-pilfer flap configured to move in coordination with opening of the delivery bin door, the anti-pilfer flap including a counterweight positioned to reduce a force required to mechanically open the delivery bin door.

4. The method of claim 3, further comprising:

providing a flap gear having teeth engaging the main gear and connected to the at least one anti-pilfer flap; and providing a cam configured to move in tandem with the main gear and to hold the flap gear in position once the at least one anti-pilfer flap is closed.

5. The method of claim 1, wherein the delivery bin door is configured to open by sliding downward, the delivery bin door biased toward the closed position.

6. The method of claim 1, wherein the delivery bin door is moveable between the open and closed positions with a force less than five pounds.

* * * * *